US009961983B2

(12) United States Patent
Carey

(10) Patent No.: US 9,961,983 B2
(45) Date of Patent: May 8, 2018

(54) DEVICE FOR SUPPORTING EYELASH EXTENSIONS

(71) Applicant: Lindsay Carey, Springville, UT (US)

(72) Inventor: Lindsay Carey, Springville, UT (US)

( * ) Notice: Subject to any disclaimer, the term of this patent is extended or adjusted under 35 U.S.C. 154(b) by 208 days.

(21) Appl. No.: 14/729,333

(22) Filed: Jun. 3, 2015

(65) Prior Publication Data

US 2016/0353861 A1 Dec. 8, 2016

(51) Int. Cl.

| | |
|---|---|
| ***A45D 44/00*** | (2006.01) |
| ***A41G 5/02*** | (2006.01) |
| ***A45D 44/14*** | (2006.01) |

(52) U.S. Cl.

CPC ..... *A45D 44/00* (2013.01); *A41G 5/02* (2013.01); *A45D 44/14* (2013.01)

(58) Field of Classification Search

CPC ..... A45D 44/00; A45D 44/04; A45D 44/14; A45D 44/16; A41G 5/02

See application file for complete search history.

(56) References Cited

U.S. PATENT DOCUMENTS

| | | | | |
|---|---|---|---|---|
| 5,865,189 | A * | 2/1999 | Andrews | B26B 21/00 132/200 |
| 8,186,022 | B2 * | 5/2012 | Roser | H04R 1/1091 24/11 R |
| 8,701,685 | B2 | 4/2014 | Chipman | |
| 8,881,744 | B2 | 11/2014 | McKinstry | |
| 2016/0106172 | A1 * | 4/2016 | Kelson | A45F 5/00 132/201 |

* cited by examiner

*Primary Examiner* — Rachel Steitz

(74) *Attorney, Agent, or Firm* — Jason P. Webb; Pearson Butler

(57) ABSTRACT

A device for supporting eyelash extensions during the use thereof. The device includes an articulatable support having a first connector proximate a first end. The device includes a base coupled to a second end of the articulatable support. The base includes a coupling structure. The articulatable support is selectably coupled to the base. The device for supporting eyelash extensions includes a display platform selectably coupled to the base by operation of the coupling structure thereof. The display platform includes a recess and an array of arches each tilted with respect to the display platform shaped and sized to support eyelash extensions. The array of arches are differently sized. The array of arches have a smooth and hard outer surface.

18 Claims, 4 Drawing Sheets

DEVICE FOR SUPPORTING EYELASH EXTENSIONS

BACKGROUND OF THE INVENTION

Field of the Invention

The present invention relates to supporting structures, specifically a device for supporting eyelash extensions.

Description of the Related Art

Eyelash Extensions is a practice that enhances the length, thickness and fullness to natural eyelashes. The extensions may include silk, mink, and/or synthetic hair. Methods of applying the extensions include full strips, clusters, and individual, one-by-one extensions.

Eyelash extension services may range between $100 to $500 in the United States, depending on the type and number of lashes used, the skill of the cosmetician, and the venue where extensions are performed. It usually takes an hour to two hours to attach a full new set. An average person might have anywhere from thirty to eighty lashes per eye. The variance in the number of lashes accounts for the difference in how long it takes to apply them. Eyelash extensions usually last around 3-4 weeks, after which one will notice that the eyelash extensions have started falling out or thinning. Maintaining a full set of lashes will require refill service approximately every 3-4 weeks. Eyelash extensions come in various lengths, colors and thicknesses, from natural-looking, to glamorous, as well as dramatic.

Applying eyelash extensions to a person generally includes: washing the person's eyelashes to remove any makeup and/or dirt; allowing the eyelashes to dry; covering the bottom lashes with an adhesive pad or tape; combing the lashes to insure that they are smooth and separated; making a small amount of adhesive available, usually by squeezing out from an adhesive container a dime-sized drop of adhesive onto a surface; picking up an eyelash extension, generally with tweezers and from a container where it is stored; applying an adhesive to the base of the eyelash extension, usually by dragging the base through the drop of adhesive; applying the extension onto the natural lash, usually 1-2 mm from the eyelid, generally one lash at a time, making sure that the lashes are separated; and allowing the extension to dry.

The containers used to hold the lashes are generally the containers in which they are purchased. The containers are usually placed on a nearby flat surface (e.g. table, counter) so the lashes can be near where they will be applied. The adhesive is usually placed on a smooth flat surface near where the extensions will be applied.

Some improvements have been made in the field. Examples of references related to the present invention are described below in their own words, and the supporting teachings of each reference are incorporated by reference herein:

U.S. Pat. No. 8,881,744, issued to McKinstry, discloses a lash holder having a U-shaped sheet comprising of a curved top part and a bottom part fixed at a designated place; the curved top part is intended for setting at least one strip with numerous lashes for increasing, enlarging and separating the space between the top of the lashes, so that it is easy for the user to take off individual lashes.

U.S. Pat. No. 8,701,685, issued to Chipman, discloses an eyelash extension system includes an extension strip with a backing and a plurality of eyelash extensions. Each extension has a proximal end and a distal end. The proximal end of each extension is joined to the backing and distal end of each extension extends away from the backing. The system also includes an extension tray with at least one curved extension attachment surface to receive the extension strip such that adhering the extension strip to the curved extension attachment surface spreads the distal ends of the extensions farther apart than the proximal ends of the extensions joined to the backing.

The inventions heretofore known suffer from a number of disadvantages which include being difficult to use, being cumbersome to use, being limited in application, being limited in use, being limited in flexibility, being unable to support eyelashes, being expensive, being inefficient, being limited in support, making it difficult to see lashes during use (i.e. application on a person), failing to make it easy to pick up lashes, slowing down the application process, failing to make it easy to select between various lashes, being inconvenient, requiring a large workspace, requiring nearby tables/counters/etc., requiring too much effort to apply lashes, failing to reduce the time it takes to apply lashes, and/or failing to reduce appointment durations for eyelash extension application by professionals.

What is needed is a device for supporting eyelash extensions that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available supporting devices. Accordingly, the present invention has been developed to provide a device for supporting eyelash extensions and tools for applying eyelash extensions.

According to one embodiment of the invention, there is a device for supporting eyelash extensions during the use thereof. The device may include an articulatable support that may have a first end and a second end, opposite the first end. The articulatable support may include a first connector proximate the first end. The first connector may be a clamp. The articulatable support may be a flexible arm.

The device may include a base that may be coupled to the second end of the articulatable support. The base may include a coupling structure; wherein the coupling structure may be a track. The articulatable support may be selectably coupled to the base. The base may be a tray with an open side.

The device for supporting eyelash extensions may include a display platform that may be selectably coupled to the base by operation of the coupling structure thereof. The display platform may include a recess that may be shaped and sized to support a disposable cup containing eyelash adhesive. The display platform may include an array of arches that may each be tilted with respect to the display platform that may be shaped and sized to support eyelash extensions. The array of arches may be differently sized. The array of arches may have a smooth and hard outer surface. The recess may be disposed above the array of arches.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
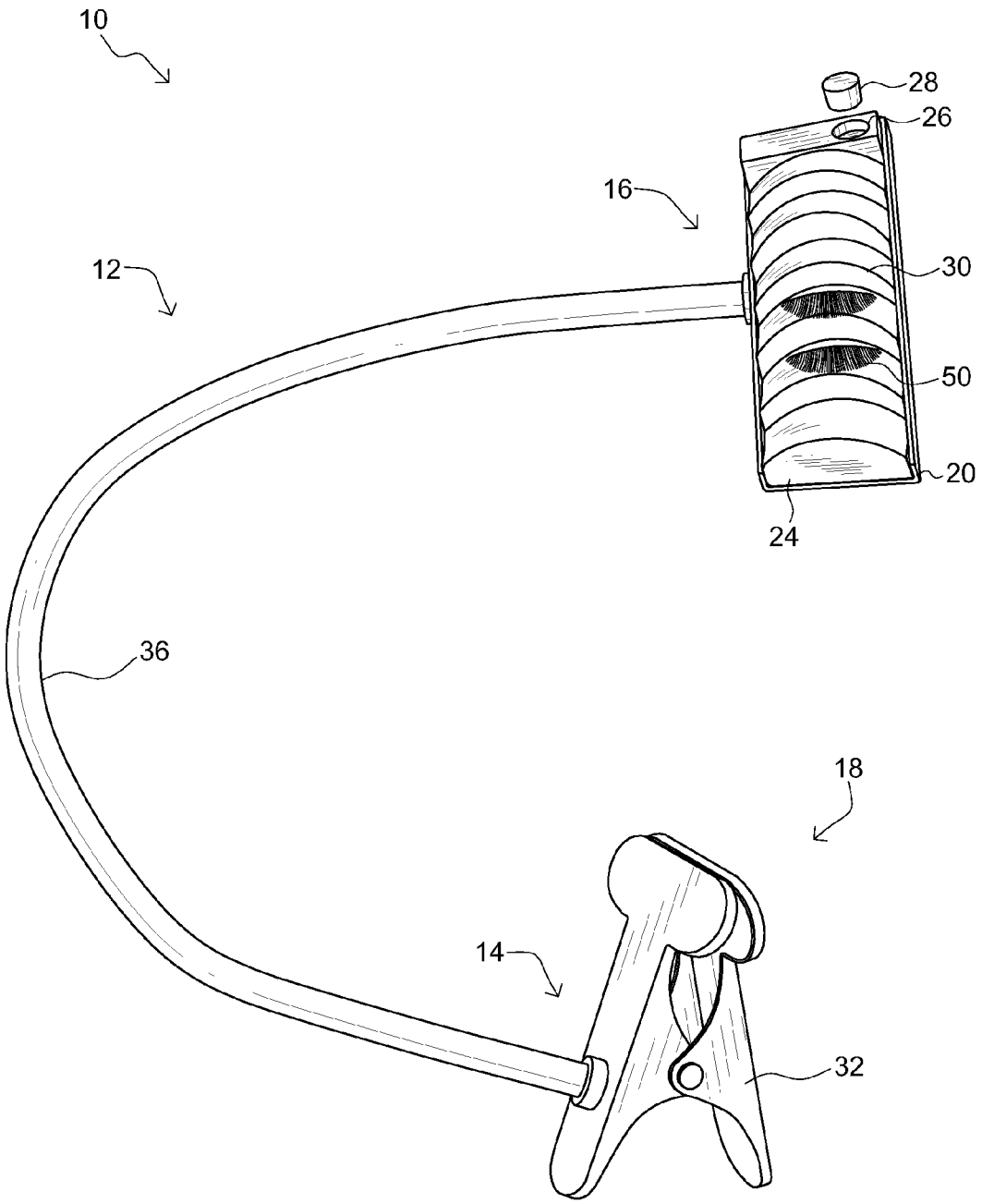
FIG. 1 is a perspective view of a device for supporting eyelash extensions, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of a device for supporting eyelash extensions, according to one embodiment of the invention. There is shown a device for supporting eyelash extensions 10 including an articulatable support 12 having a first end 14 and a second end 16, a base 20, and a display platform 24 with an array of arches 30 shaped and sized to support eyelash extensions 50.

The illustrated device for supporting eyelash extensions 10 during the use thereof. The device 10 includes an articulatable support 12 having a first end 14 and a second end 16, opposite the first end 14. The illustrated articulatable support 12 includes a first connector 18 proximate the first end 14. The illustrated first connector 18 is a clamp 32, however the first connector 18 may be a variety of connectors to securely support the articulatable support 12 and the components of the device 10 during use. The first connector 18 may be a clamp, a suction cup, a magnet, snaps, clips, screws, bolts, friction fittings, a selectably removable coupling device, etc. and still perform its intended function. The illustrated articulatable support 12 is a flexible arm 36 designed to articulate and move about when not in use, and be able to hold firm during use.

The illustrated device for supporting eyelash extensions 10 includes a base 20 coupled to the second end 16 of the articulatable support 12. The base 20 extends from the second end 16 and is coupled thereto by a coupling device. The base 20 couples to the articulatable support 12 from a side of the base 20. The base 20 is designed to rotate about the articulate support 12 to provide a desired angle to support the eyelash extensions. The articulatable support 12 is selectably coupled to the base 20.

Figure 3:
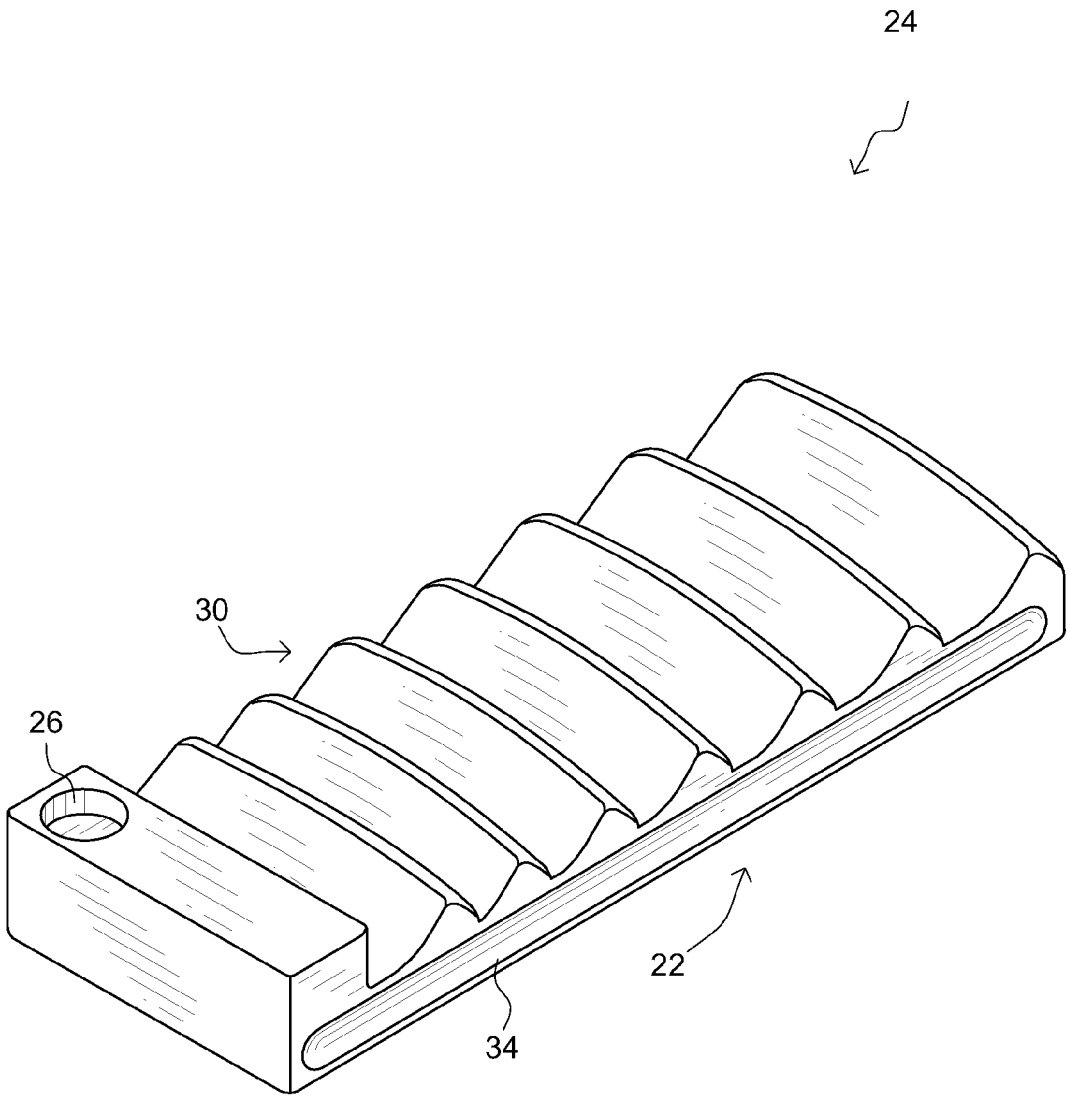
FIG. 3 is a perspective view of a display platform of a device for supporting eyelash extensions, according to one embodiment of the invention.
Figure 4:
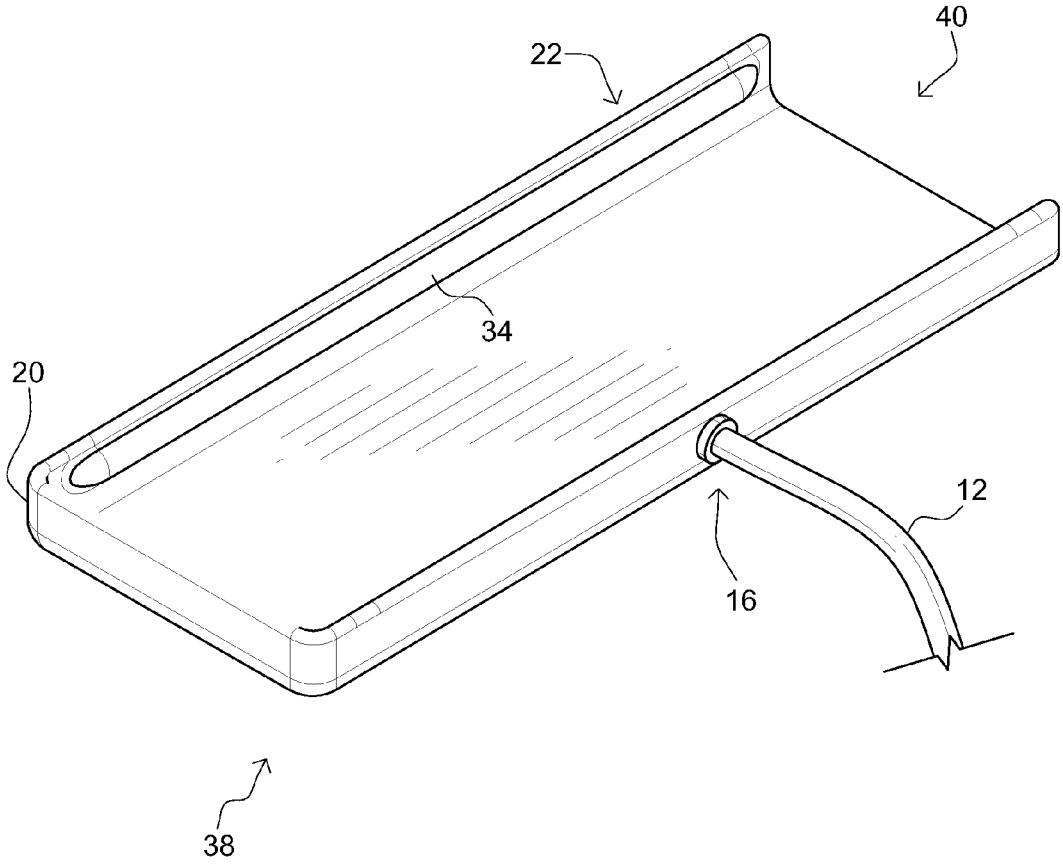
FIG. 4 is a perspective view of a base of a device for supporting eyelash extensions, according to one embodiment of the invention.

The illustrated device for supporting eyelash extensions 10 includes a display platform 24 selectably coupled to the base 20 by operation of a coupling structure thereof (not shown in FIG. 1, but is illustrated in FIGS. 3 and 4). The display platform 24 includes a recess 26 shaped and sized to support a disposable cup 28 containing eyelash adhesive. The display platform 24 includes an array of arches 30 each array is tilted with respect to the display platform 24 and shaped and sized to support eyelash extensions 50. The array of arches have a smooth and hard outer surface. The illustrated recess 26 is disposed above the array of arches 30.

The illustrated array of arches have a stair-step or scalloped pattern to them, wherein adjacent arches are coupled by a drop that is substantially perpendicular to the surface of the arches coupled thereby. The arches are tilted with respect to the overall plane of the display platform so that when the center of the arches is oriented in a manner that supports extensions thereon in an orientation that makes them easy to see, they are also displayed in a manner that separate extensions are not blocking view of each other and the drops are viewed at an angle that causes them to appear to be short, while the arches themselves and thus the extensions which rest thereupon are viewed more directly. The arches are nested within each other and coupled to each other by a drop between each adjacent pair of arches. The curved top surface of each illustrated arch is at about a 45 degree angle with respect to the plane of the display platform and each of the illustrated drops is also at about a 45 degree angle with respect to the plane of the display platform. Accordingly, when viewed from the side, the arches and drops form a saw-tooth-like profile.

According to one embodiment of the invention, there is a device for supporting eyelash extensions 10 designed to lift a user's workspace and support a plurality of eyelash extensions and eyelash extension adhesive in a manner that provides easy access during use thereof. The device may include a bottom base with a clamp attached thereto that may be used to attach the device to something else (e.g. table, counter, lamp). The bottom base may also include a long flexible/articulable stem/support extending therefrom. Advantageously, the stem/support selectably disposes the attached structure to a position and orientation that is suitable and helpful in the use thereof, generally raising the attached structure (i.e. the platform and associated palette) higher than the table surface and orienting the same so that the extensions disposed thereon are easy to see and easy to pick up. Wherein the stem is flexible or selectably articulable it may be readjusted to suit various circumstances, even in the middle of an application session.

Opposite the bottom base and coupled to the stem/support may be a platform/base including a coupling structure to couple to a display platform/palette that may be ceramic or otherwise smooth/hard. The platform may include rails that mate with corresponding structure (e.g. grooves) on the display platform/palette so that the palette may slide into coupling therewith and may be selectably removed therefrom. Advantageously, this permits one to load the palette with lashes in one place and then easily move the palette to another place where the device is prepared to receive it during operation thereof.

The top surface of the palette includes a plurality of reclined arches having various sizes and spacing to allow for various extensions of different sizes and shapes to be disposed thereon. The shape of the arches cause the extensions disposed thereon to fan out instead of being compressed, thus making them easier to work with.

One or more drops/portions of adhesive may be placed on various portions of the palette, including but not limited to on any flat surface thereof (e.g. a top flat surface near the well/concave region), in a well/concave region disposed thereon, in a cup disposed within such a well or concave area, and/or on one of the arches (generally the bottom one).

In operation, a person desiring to apply eyelash (or eyebrow or similar extensions) extensions to a person may attach the device to a convenient structure and then adjust the stem to place the platform in a desired position and/or orientation. The operator may then take the palette/display platform to a place where eyelash extensions are stored and place a variety of extensions on the arches thereof. The operator may then return to the site of operation and secure the palette to the platform. The operator may review the extensions thereon with the person to which they will be applied, such as but not limited to talking with them about which extensions of those selected might be most suitable for application. The operator may place a dollop of adhesive on the device in one or more of places suitable therefor. The operator may then select an extension, take hold of the extension in an easy and convenient motion, apply adhesive thereto without having to move their arm to another position and then easily and simply apply the extension to the person to which it is to be applied with only a minimum of motion. Accordingly, the entire process is more convenient, easier, quicker, safer, less taxing, and/or more efficient than it would otherwise have been.

Figure 2:
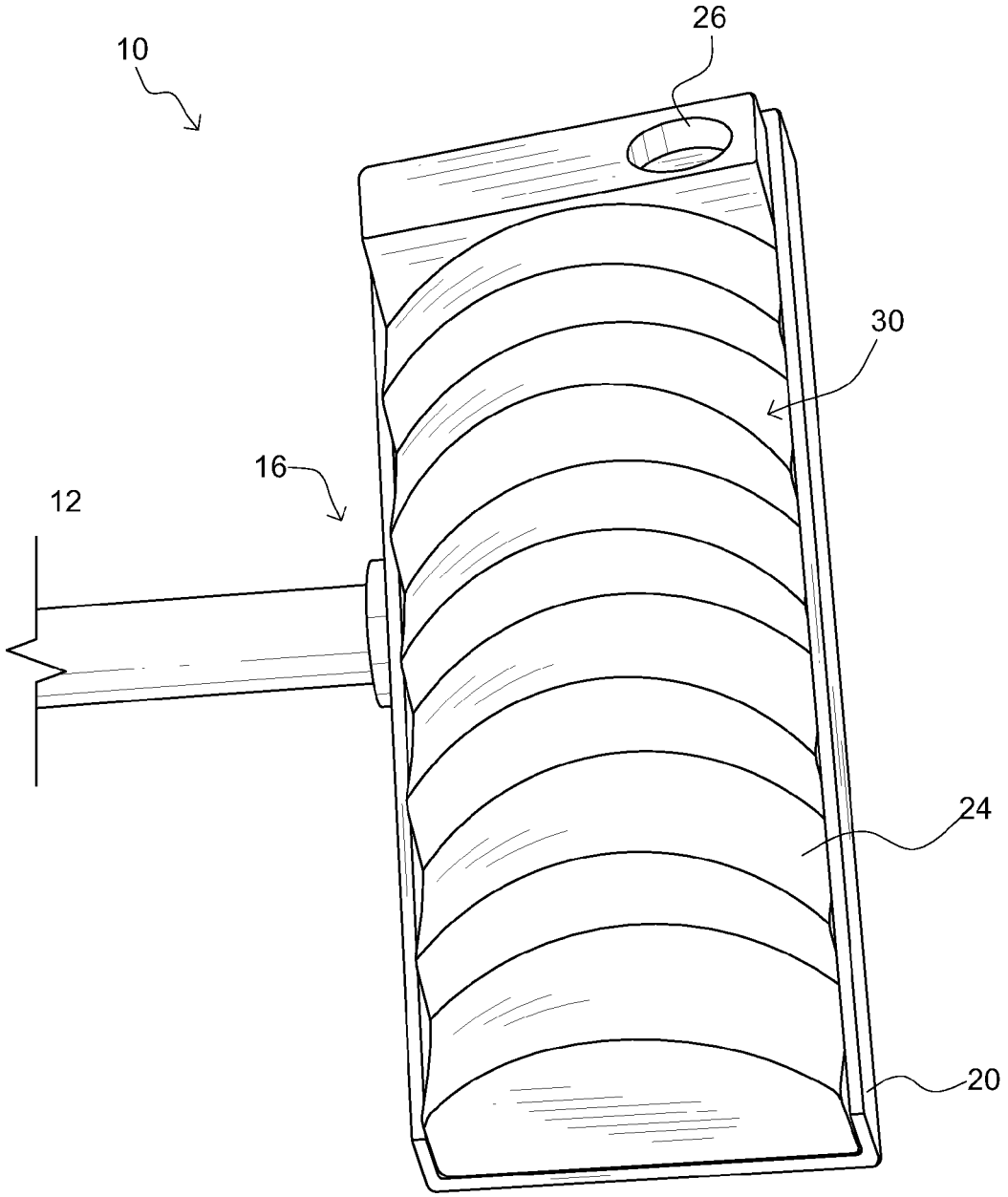
FIG. 2 is a perspective view of a display platform and an articulatable support of a device for supporting eyelash extensions, according to one embodiment of the invention.

FIG. 2 is a perspective view of a display platform and an articulatable support of a device for supporting eyelash extensions, according to one embodiment of the invention. There is shown a device for supporting eyelash extensions 10 including a display platform 24 selectably coupled to a base 20, wherein the base 20 is coupled to an articulatable support 12.

The illustrated device for supporting eyelash extensions 10 includes an articulatable support 12 having a second end, opposite a first end (not shown). The articulatable support 12 is a flexible arm designed to support a base 20 and a display platform 24 in a plurality of angles and configurations to assist in applying eyelash extensions on a user.

The illustrated base 20 is coupled to the second end 16 of the articulatable support 12. The articulatable support 12 is selectably coupled to the base 20. The illustrated display platform 24 is selectably coupled to the base 20 by operation of a coupling structure thereof (not shown). The display platform 24 includes a recess 26 shaped and sized to support a disposable cup, or any circular liquid holding device, containing eyelash adhesive for easy use during application of the eyelash extensions. The display platform 24 includes an array of arches 30 each arch is tilted with respect to the display platform 24 and shaped and sized to support eyelash extensions. The array of arches 24 are differently sized. The array of arches 30 have a smooth and hard outer surface to easily remove eyelash extensions therefrom.

FIG. 3 is a perspective view of a display platform of a device for supporting eyelash extensions, according to one embodiment of the invention. There is shown a display platform 24 including a recess 26 for supporting a cup and an array of arches 30 shaped and sized to support a plurality of eyelash extensions.

The illustrated device for supporting eyelash extensions 10 during application thereof. The device 10 includes a display platform 24 selectably couplable to a base of the device 10, by operation of a coupling structure 22 thereof. The coupling structure 22 is designed to correspond to a coupling structure disposed on a base (not shown) and configured to mate thereto. The display platform 24 is designed to selecatbly slide into the base; wherein corresponding tracks 34 mate together to secure the display platform 24 to the base.

The illustrated display platform includes a recess 26 shaped and sized to support a disposable cup or container having eyelash adhesive disposed therein. The display platform 24 includes an array of arches 30, wherein each arch is tilted with respect to the display platform 24. Each arch 30 is shaped and sized to support an eyelash extension. The illustrated array of arches 30 are differently sized to support various sizes of eyelash extensions. The array of arches 30 have a smooth and hard outer surface. The recess 26 is disposed above the array of arches 30. The display platform 24 may be reuseable or disposable.

FIG. 4 is a perspective view of a base of a device for supporting eyelash extensions, according to one embodiment of the invention. There is shown a base 20 including a coupling structure 22 and an open side 40.

The illustrated base 20 is coupled to a second end 16 of an articulatable support 12 of a device for supporting eyelash extensions. The base 20 includes a coupling structure 22; wherein the coupling structure 22 is a track 34. The articulatable support is designed to selectably couple to the base 20. The base 20 may be designed to rotate about the articulatable support to provide an easier angle or configuration to access and apply eyelash extensions. The illustrated base 20 is a tray 38 with an open side 40. The open side 40 is designed to receive a display platform of a device for supporting eyelash extensions. The coupling structure 22 of the base 20 corresponds to a coupling structure of the display platform, thereby securing the display platform within the base 20. The illustrated coupling structure 22 is a track 34 designed to correspond to a track disposed on the display platform, thereby mating the display platform to the base 20.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although a clamp is illustrated as the first connector, a threaded nut is illustrated as a connector between the illustrated support and the platform/base, and a tongue and groove structure is illustrated as coupling the platform and the display platform, it is understood that there are a variety of connectors that may be used between such including but not limited to snaps, clips, clamps, screws, bolts, integral fixings, hook and loop, magnets, tongue and groove, friction fitting and the like and combinations thereof.

Additionally, although the figures illustrate angular orientation of the arches and/or drops of about 45 degrees each with respect to the plane of the display platform, such may be between about 15, 20, 25, 30, 35, 40, 45, 50, 55, 60, 65, 70, and/or about 75 degrees from the plane of the display platform and or may be orientated at between about 70, 75, 80, 85, 90, 95, 100, 105, and/or about 110 degrees with respect to each other and such angular orientations may be vary from arch to arch and/or from drop to drop along the length of the display platform.

It is also envisioned that while the illustrated embodiment in FIG. 3 shows seven arches of substantially equal width and angular orientation separated from each other by six drops, there may more or fewer arches that may be of varying orientations from that shown and/or from each other and that may have width(s) and/or proportional width(s) that are different from that shown and/or different from each other.

Further, while the figures illustrate a recess/cavity/hole configured to receive a drop of adhesive and to store the same and that recess is illustrated as being on the display platform, there may be a recess/cavity/hole disposed on the platform to which the display platform attaches, wherein the base platform may include one or more flanges/protrusions/extension members or the like that may protrude from one or more sides of the base platform and on which may exist one or more recesses/holes/cavities/etc. on which an amount of adhesive may be deposited.

It is expected that there could be numerous variations of the design of this invention. An example is that the display platform could be circular instead of rectangular.

Finally, it is envisioned that the components of the device may be constructed of a variety of materials, including but not limited to ceramic, plastics, resins, rubbers, metals, wood, fibers, woven fibers, glass, natural/synthetic stone and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A device for supporting eyelash extensions during the use thereof, comprising:

a) an articulatable support having a first end and a second end, opposite the first end, and a first connector proximate the first end;

b) a base coupled to the second end of the articulatable support and including a coupling structure; and c) a display platform non-destructably removably coupled to the base by operation of the coupling structure thereof and including:

c1) a recess shaped and sized to support a disposable cup containing eyelash adhesive; and c2) an array of arches that are each tilted with respect to the display platform that are shaped and sized to support eyelash extensions, wherein the articulatable support is firm such that it supports the base and display platform above the first connector against the pull of gravity such that it lifts a user's workspace.

2. The device of claim 1, wherein the first connector is a clamp.

3. The device of claim 1, wherein the coupling structure is a track and the display platform is slideably coupleable to and slideably removable from the base thereby.

4. The device of claim 1, wherein the array of arches are differently sized.

5. The device of claim 1, wherein the articulatable support is removably coupled to the base and recoupleable thereto by operation of a second connector.

6. The device of claim 1, wherein the articulatable support is readjustable to allow the display platform to be firmly supported by the articulatable support above the first connector in a desired position and orientation.

7. The device of claim 1, wherein the array of arches have a smooth and hard outer surface.

8. The device of claim 1, wherein the recess is disposed above the array of arches.

9. The device of claim 1, wherein the base is a tray with an open side into which the display platform slides to couple thereto and from which the display platform slides to decouple therefrom.

10. A device for supporting eyelash extensions during the use thereof, comprising:

a) an articulatable support having a first end and a second end, opposite the first end;

b) a base coupled to the second end of the articulatable support and including a coupling structure that facilitates attachment and removal therefrom; and c) a display platform coupled to the base by operation of the coupling structure thereof such that the display platform is removable and re-coupleable thereto and including:

c1) a recess shaped and sized to support a disposable cup containing eyelash adhesive; and c2) an array of arches that are each tilted with respect to the display platform that are shaped and sized to support eyelash extensions, wherein the articulatable support holds firm as a support for the base to rest upon during use of the base and articulates under force.

11. The device of claim 10, wherein the coupling structure is a track into which the display platform slides when coupling thereto and out of which the display platform slides when decoupling therefrom.

12. The device of claim 11, wherein the array of arches are differently sized.

13. The device of claim 12, wherein the articulatable support is removably coupled to the base.

14. The device of claim 13, wherein the articulatable support is a flexible arm.

15. The device of claim 14, wherein the array of arches have a smooth and hard outer surface.

16. The device of claim 15, wherein the recess is disposed above the array of arches.

17. The device of claim 16, wherein the base is a tray with an open side inside which the display platform is disposed.

18. A device for supporting eyelash extensions during the use thereof, comprising:

a) a firm articulatable support capable of supporting materials above the support against the pull of gravity having a first end and a second end, opposite the first end, and a first connector proximate the first end; wherein the first connector is a clamp; wherein the articulatable support is a flexible arm;

b) a base coupled to the second end of the articulatable support and including a coupling structure; wherein the coupling structure is a track; wherein the articulatable support is selectably coupled to the base; wherein the base is a tray with an open side; and c) a display platform removably coupled to the base by operation of the coupling structure thereof, wherein the display platform slides into and out of the open side via coupling with the track with rails that mate with grooves in the track and including:

c1) a recess shaped and sized to support a disposable cup containing eyelash adhesive; and c2) an array of arches that are each tilted with respect to the display platform that are shaped and sized to support eyelash extensions; the array of arches are differently sized; wherein the array of arches have a smooth and hard outer surface; wherein the recess is disposed above the array of arches.

* * * * *